United States Patent [19]

Richardson

[11] Patent Number: 4,534,067

[45] Date of Patent: Aug. 13, 1985

[54] FLY CONSTRUCTION AND METHOD OF FORMING IT

[75] Inventor: Donald Richardson, Atkinson, N.H.

[73] Assignee: The Reece Corporation, Waltham, Mass.

[21] Appl. No.: 491,872

[22] Filed: May 5, 1983

[51] Int. Cl.[3] ..... A41D 1/06

[52] U.S. Cl. ..... 2/234; 2/243 R; 112/265.2

[58] Field of Search ..... 2/234, 227, 211, 218, 2/243 R, 265; 112/104, 113, 147, 151, 265.2

[56] References Cited

U.S. PATENT DOCUMENTS

| | | | |
|---|---|---|---|
| 2,176,229 | 10/1939 | Siegel | 2/234 |
| 2,236,218 | 3/1941 | Marks | 2/234 |
| 2,434,233 | 1/1948 | Spearrin | 2/234 |
| 2,642,827 | 6/1953 | Sherman | 112/141 |
| 2,894,469 | 7/1953 | Van Amburg et al. | 112/136 |
| 3,110,901 | 11/1963 | Lesnow | 2/234 X |
| 3,120,004 | 2/1964 | McGehee | 2/234 |
| 3,311,926 | 4/1967 | Gerber | 2/128 |
| 3,648,293 | 3/1972 | Del Veochio | 2/234 X |
| 3,827,085 | 8/1974 | Ackermann | 2/234 |

*Primary Examiner*—H. Hampton Hunter

*Attorney, Agent, or Firm*—Garrett J. Cullen, Jr.

[57] ABSTRACT

This invention relates to a fly structure for trousers or the like, and more particularly to a fly structure formed from flaps which are integral with the front panels of the trousers or the like. The flap forming the outer or exposed flap portion of the fly is folded in a manner to provide reinforcement along the free edge and to simulate the construction obtained using fly flap pieces independent of the front panels of the trousers or the like.

35 Claims, 6 Drawing Figures

FLY CONSTRUCTION AND METHOD OF FORMING IT

BACKGROUND OF THE INVENTION

Traditionally, the construction of the fly in trousers or the like has entailed a plurality of parts requiring rather precise cutting, matching and registration with one another. The fact is that the complexity of popular closures for trousers or the like presently requires skillful persons in order to form consistent, uniform closures acceptable to the consuming public. In view of the large amount of handling and hand labor in positioning the parts, it has been impossible to speed up this task and reduce the cost of the fly making operation.

In the manufacture of trousers or the like the common method employed is to cut front panels from the material supply and to separately cut fly flap pieces from the material supply. Slide fastener strips are then attached in predetermined position on the fly flap pieces after which the fly flap pieces are attached to the front panels in the desired position. The front panels are then attached to each other at the crotch portion with the slide fastener strip lying between the fly flap pieces.

In attaching the fly flap piece to the front panel which is to provide the outer or exposed portion of the fly structure a seam is formed along the free edge of the fly structure by the doubling back of the fly piece. This seam provides both rigidity due to the extra layers of material and also reinforcement for the fly structure.

Attempts have been made to form the fly structure from flaps which are integral with the front panels but, these structures have lacked the rigidity desired and accomplished by attaching the fly flap pieces which were separate from the panels. Various solutions to this problem including the addition of a separate strip to provide reinforcement and rigidity have proven unsatisfactory.

SUMMARY OF THE INVENTION

The object of the invention is to provide a fly structure for trousers or the like wherein the fly flap pieces are integral with the front panels and the desirable rigidity of the structure is obtained.

Another object of the invention is to provide a method of folding a fly flap portion whereby a fly structure can be formed from a fly flap portion integral with the front panel without the use of additional material to provide rigidity.

A further object of the invention is to provide an inverted fold along the free edge of the exposed flap of a fly structure formed from a front panel having the fly flap portion integral therewith.

A still further object of the invention is to provide a fly construction for trousers or the like wherein the assembly task is simplified and can be consistently and uniformly repeated by persons having minimum skill in forming such assemblies in a minimum amount of time.

Yet another object of the invention is to provide a fly structure having the appearance, wear characteristics and structural integrity equal to that obtained from construction using fly flap pieces separate from front panels.

A further object is to provide a basic fly structure which can be utilized in other apparel applications.

In the method of the invention the front panels of the trousers or the like are cut from the material supply with the fly flap portion integral therewith. The flap portion on the front panel which is to form the covered flap of the fly structure is doubled back upon itself to form a pocket for receiving a slide fastener stringer and then folded back to provide a finished edge spaced from the stringer. The fly flap portion forming the exposed flap is folded back along a line forming the free edge of the flap and then the other matching slide fastener is secured in position on the folded back portion. The free edge of the flap is inverted inwardly to form a V-shaped wedge lying between the layers of material and this wedge is secured in place in a suitable manner. The V-shaped wedge forms a double fold along the free edge and the fold which is disposed to the rear in the finished fly structure may be recessed behind the outer or exposed fold.

In securing the slide fastener stringer to the folded back portion of the exposed flap the stringer can be secured in flat position on the folded back portion or the folded back portion can be doubled back upon itself to provide a pocket for receiving the other matching slide fastener stringer.

It is understood that the foregoing is merely an illustration of the fly structure and method of the invention. For a more complete understanding of the invention and its advantages, reference should be made to the following detailed description of the preferred embodiments and to the accompanying drawings

DESCRIPTION OF THE DRAWINGS AND PREFERRED EMBODIMENT

Figures 1, 2:
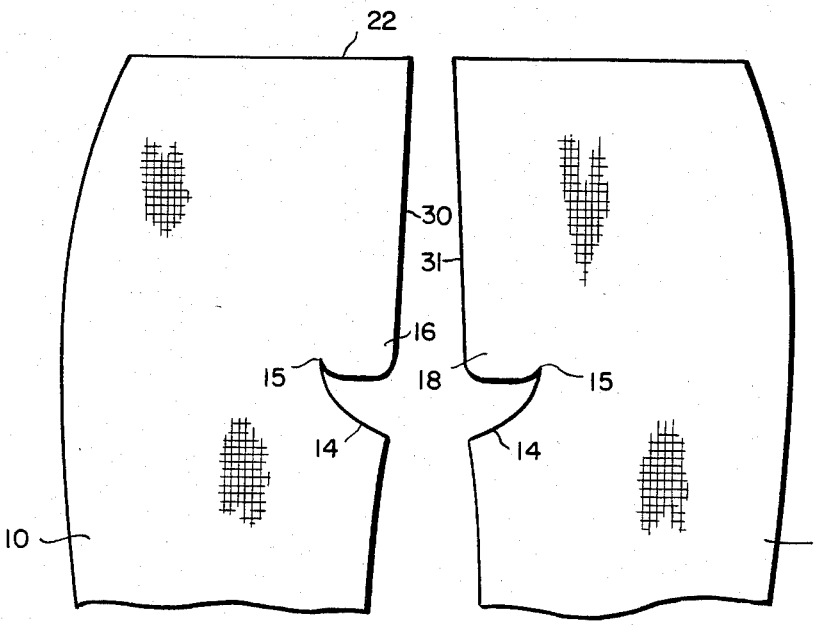
FIG. 1 is a view of the upper portion of a right front panel for trousers or the like with the fly flap forming portion integral therewith.
FIG. 2 is a view of the upper portion of a left front panel for trousers or the like with the fly flap forming portion integral therewith.

Referring now to FIG. 1, there is shown a right front panel 10 which has been cut from the supply of material. In FIG. 2 is shown a left front panel 12 which is a reverse image of the right front panel 10 although it is not necessary that the two panels be similar. Each panel is provided with a cut out area 14 which terminates in a slit 15 in what is to become the crotch portion of the trousers or the like. The upper edge of the cut out area 14 defines the lower edge of the fly flap portion 16 of the right front panel 10 and the lower edge of the fly flap portion 18 of the left front panel 12.

Figure 4:
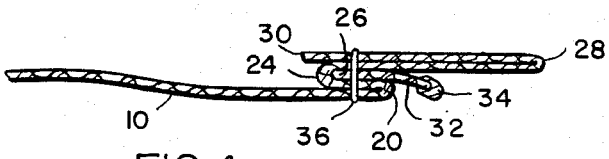
FIG. 4 is a cross sectional view taken along, line 4—4 of FIG. 3 and showing the completed right flap formed according to this invention.
Figure 3:
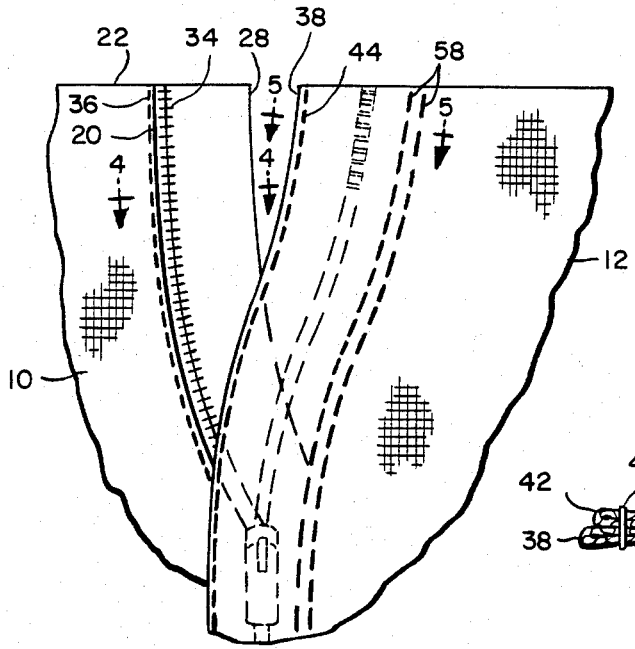
FIG. 3 is a front view of the completed fly structure formed according to this invention.

The folds of the right front panel 10 necessary to complete the right fly structure are shown in FIG. 4. The material comprising the right front panel is provided with a fold 20 which turns the material back upon itself to its reverse side. This fold line 20 will extend from the innermost point of the cut out 14 to the upper or waist band edge 22 of the right front panel 10 at a predetermined angle as shown in FIG. 3.

The material has a second fold 24 placing the material in face to face relation to provide a slit type pocket 26 running from the bottom edge of the flap to the upper edge 22. The material has a further fold turning the material back upon itself to its reverse side to provide a free finished edge 28 for the right fly flap. The edge 30 of the material forming the fly flap portion 16 extends back beyond the pocket 26. The edge 30 of the material can be finshed in any known manner such as by serging or the like.

The tape portion 32 of one half of a slide fastener stringer is located within the pocket with the slide fastener elements 34 being exposed. A line of stitches 36 passes through both of the layers of material which form the fold line 20, the tape portion 32, the layer of material which forms the back side of the pocket 26 and the layer of material which extends back from the free finished edge 28 of the fly flap. Thus all the elements forming the right fly flap are secured in position by a single row of stitching 36.

Figure 5:
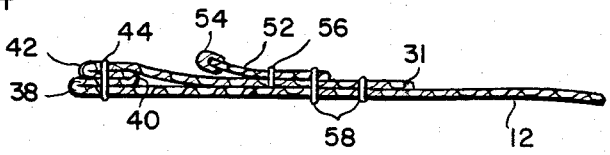
FIG. 5 is a cross sectional view taken along line 5—5 of FIG. 3 and showing a completed left flap formed according to this invention; and, FIG. 6 is a cross sectional view similar to FIG. 5 and showing a modified form of a complete left flap formed according to this invention.

FIG. 5 shows the folds involved in forming the left fly flap structure of the present invention. The material forming the left front panel 12 is provided with a fold 38 wherein the reverse sides of the material are in abutting relation. This fold line 38 will extend from the innermost point of the cut out 14 to the upper or waist bank edge 22 of the left front panel 12 at a predetermined angle as shown in FIG. 3.

The material is further provided with a fold 40 closely adjacent fold 38 wherein the face sides of the material abut each other. A fold 42 is provided in line with fold 38 and turns the material back upon itself with the reverse sides of the material abutting each other. This results in a substantially V-shaped portion of the material being trapped between the outer portions of the folds 38 and 42. A line of stitches 44 passes through the outer portions of the material and both legs of the V-shaped portion to secure the folds in position. There is thus provided a free edge on the left fly flap which has additional rigidity and reinforcement.

Figure 6:
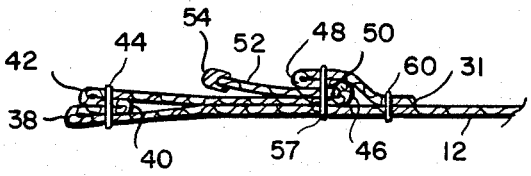

In forming the folds 38 and 42 it is preferable to recess the fold 42 behind the fold 38 as shown in FIGS. 5 and 6. This presents a pleasing appearance in the finished structure. While the two folds 38 and 42 may equal each other, in no case should fold 42 extend beyond fold 38 and thereby be exposed in the finished fly structure.

At a predetermined distance from the folds 38 and 42 formed on the left fly structure the other half of the slide fastener stringer is attached to the portion of the material extending back from the fold 42 by a line of stitches 56. The stitches 56 pass through the slide fastener tape 52 and the single layer of material so as to be invisible from the exposed face of the completed left fly flap. The slide fastener elements 54 are disposed in a direction toward the fold 42 and are adapted to engage with the elements 34 on the half of the stringer 32 mounted on the right fly portion.

The turned back portion of the left fly portion is secured to the reverse face of the left trouser panel. In the structure shown this is accomplished by two parallel rows of stitching 58. One row of stitching 58 passes through three layers of material, the tape 52, the turned back portion of the fly portion and the trouser front panel. The other row of stitching 58 only passes through two layers of material, the turned back portion of the left fly portion and the trouser front panel. The free edge 31 of the left fly flap portion can be finished in any known manner, such as, by serging or the like.

FIG. 6 shows a modified version of attaching the slide fastener stringer 52 to the left fly flap structure. The construction of the folds 38 and 42 is the same as that described in connection with FIG. 5. In attaching the tape 52 the turned back portion of the left fly flap portion is provided with a fold 46 at a predetermined distance from the fold 42 which results in the material being back to face to face relationship. Closely adjacent to fold 46 is a fold 48 which reverses the direction of the material and results in forming a longitudinal slit type pocket 50 in which the tape portion 52 of the other half of a slide fastener stringer is disposed. The slide fastener elements 54 are disposed outwardly of the pocket 50 and are adapted to engage with the elements 34 on the half of the stringer mounted on the right fly portion. A row of stitches 57 passes through the left panel 12, the layers of material forming the pocket 50, the tape 52 and the portion of the material between the fold 48 and the free edge of the original fly flap portion 18. If desired the free edge of the fly flap portion 18 can be secured to the reverse face of the material forming the left front panel by a row of stitches 60 running parallel to the rows of stitches 58. The edge 31 can likewise be finished by serging or the like. In the finished trousers or the like the right and left panels are joined at the crotch protion with the left fly panel portion overlapping the right fly flap portion and the slide fastener stringers being disposed between the two fly flap portions.

The method of forming the right fly flap structure consists of folding the fly flap portion 16 back upon itself along a predetermined line which is to become the finished free edge 28 thereof. Concurrently therewith a tuck is made in the fly flap portion along the line 20 to form a pocket 26 for receiving the tape of the slide fastener stringer. The slide fastener stringer is then inserted in place and the entire structure is held in position while the row of stitches 36 is created to permanently secure the parts in position.

The method of forming the left fly flap structure is to first double the material back upon itself adjacent the line 38 which is to form the exposed finished free edge of the left fly flap. A tuck is then made in the material along the fold to invert the edge of the fold and form the V-shaped insert between the layers of the material and the separate edges 38 and 42. The parts are then held in position and the stitching 44 applied to permanently secure the folds 38 and 42 in position.

At a predetermined distance from the fold 42 the slide fastener stringer 52 is placed in position on the turned back portion of the fly flap portion and held in position while the stitches 56 are applied to permanently attach the slide fastener stringer 52 in place. The turned back portion of the left fly flap is then clamped in position against the reverse face of the left trouser front panel and the stitching 58 applied to complete the left fly structure. The two rows of parallel stitching 58 can be applied simultaneously or one after another.

In forming the modification shown in FIG. 6 the steps outlined in connection with the method of forming and retaining the folds 38 and 42 would be followed. Following that a second tuck would be made in the left fly flap portion at a predetermined distance from the fold 42 to form the longitudinal slit type pocket 50. The tape portion 52 of the slide fastener stringer is then inserted within the pocket 50 and the assembly is held in position and the stitching 57 is applied to secure the parts in position. The stitching 60 is applied to additionally secure the free edge of the left fly front 12. The stitching 60 may be applied simultaneously with the stitching 57 or subsequently thereto.

The left and right panels are then placed in position with the left fly flap overlying the right fly flap and the lower edges of the cut out portions 14 are folded over each other. Stitching is then applied to secure the panels in position relative to each other to complete the fly structure.

It is understood that the invention is not limited to the embodiments shown and described, but many changes and modifications can be made without departing from the invention as defined in the appended claims.

What is claimed is:

1. In a fly construction for trousers or the like, left and right front panels forming the trousers or the like having a fly flap portion integral therewith, opposite tapes of a slide fastener stringer being secured to the respective fly flap portions, said left fly flap having a folded edge forming an exposed free edge of the completed fly structure, said folded edge having integral reinforcing means therein, and said left and right front panels being joined together at their crotch portions.

2. A fly construction according to claim 1 wherein, said reinforcing means for said folded edge consists of an inverted portion of the material forming a substantially V-shaped insert between the layers of material, and a row of stitching through at least one layer of material and the V-shaped insert securing the V-shaped insert in position.

3. A fly construction according to claim 2 wherein, said V-shaped insert forms a pair of lips along said folded edge.

4. A fly construction according to claim 3 wherein, one of said lips is recessed behind the other so as to be covered by the exposed lip in the completed fly construction.

5. A fly construction according to claim 4 wherein, the tape of said slide fastener stringer is secured to the left fly flap portion by a line of stitches passing through the tape and a single layer of the fly flap material.

6. A fly construction according to claim 5 wherein, the free edge of the left fly flap portion is secured to the left front panel by at least one row of stitches.

7. A fly construction according to claim 6 wherein, an S-shaped fold is provided on said right front panel along the junction line of the panel and the fly flap portion to form a slit type pocket having an opening facing away from said panel, said tape of the slide fastener stringer on the right front panel fly flap portion being disposed within said pocket with the fastener elements extending away from said pocket, and stitching passing through all the layers of said S-shaped fold and the slide fastener stringer tape to secure the fold and the stringer in position.

8. In a fly construction for trousers or the like, left and right front panels joined by stitching at the crotch area, fly flap portions of said left and right panels integral therewith, said flaps each having an S-shaped fold therein to form a slit type pocket facing the pocket in the opposite flap, a slide fastener closure having a pair of opposite tape portions, one of said opposite tape portions lying in one of said slit type pockets and the other of said opposite tape portions lying in the other of said slip type pockets, the flap on said right front panel having a finished edge spaced from the pocket formed therein, a line of stitching passing through said S-shaped fold in the flap of said right front panel and the tape portion inserted in the pocket thereof, said left flap being folded back against the reverse side of the left panel along the line defining the dividing line of the left front panel and the left fly flap portion to provide an exposed free edge for the finished left fly structure, said left flap being having an additional fold providing a double fold along the exposed free edge of the finished left fly structure, a line of stitching passing through the double fold to permanently secure the double fold in position, said S-shaped fold in the left fly being located between the double fold and the free edge of the left fly flap portion, and a line of stitching passing through said S-shaped fold in said left flap, the tape portion of the slide fastener stringer inserted therein and the left front panel.

9. A fly structure according to claim 8 wherein, the double fold in the exposed free edge of the left fly structure is formed of an inverted V-shaped section disposed between the layers of material forming the left front panel and the left flap portion.

10. A fly structure according to claim 9 wherein, said V-shaped section is integral with the left front panel and the left fly flap portion.

11. A fly structure according to claim 10 wherein, the double fold in the exposed free edge of the left fly structure forms two lips along said exposed free edge, and one of said lips is recessed behind the other whereby only one lip is visible when viewing the completed left fly structure from the front.

12. A method of forming a fly structure for trousers or the like, comprising, cutting left and right front panels from a supply of material with left and right fly flap forming portions extending from the crotch portion to the waist band edge integral with the front panels, forming an S-shaped tuck in the material along a predetermined line at the junction of the right fly flap portion and the right front panel to form a slit type pocket with the pocket being open in a direction away from said right front panel, inserting the tape portion of a slide fastener stringer in said pocket with the slide fastener elements being disposed in the direction away from said right front panel, folding the right fly flap portion back upon itself along a line spaced from said right front panel and beyond said slide fastener elements, applying a row of stitches through the S-shaped tuck, the tape portion of the slide fastener stringer and the turned back portion of the right fly flap portion, doubling back the left fly flap portion on the reverse face of the left front panel along a predetermined line at the junction of the left front panel and the left fly flap portion, applying a row of stitches to secure the doubled back fold in place, placing the tape portion of a slide fastener stringer on said left fly flap portion with the slide fastener elements being disposed in the direction toward the doubled back fold, applying a row of stitches through the tape portion of the slide fastener stringer and the left fly flap portion, and joining the left and right fly sections together at the crotch sections by applying stitching thereto.

13. A method according to claim 12 comprising, precutting said slide fastener stringers to predetermined length.

14. A method according to claim 12 comprising, providing excess material during doubling back the left fly flap portion to present fullness in the fold, and tucking the edge of said doubled back fold between the layers of the fold to provide a V-shaped insert between the layers of the fold.

15. A method according to claim 14 comprising, precutting said slide fastener stringers to a predetermined length.

16. A method according to claim 14 comprising, forming two lips along the fold line during the making of said tuck, and offsetting said tuck from the center line of said fullness in the fold to provide said two lips one of which is recessed behind the other.

17. A method of forming a fly structure for trousers or the like, comprising, cutting left and right front panels from a supply of material with left and right fly flap forming portions extending from the crotch portion to the waist band edge integral with the front panels, forming an S-shaped tuck in the material along a predetermined line at the junction of the right fly flap portion and the right front panel to form a slit type pocket with said pocket being open in a direction away from said right front panel, inserting the tape portion of a slide fastener stringer in said pocket with the slide fastener elements being disposed in the direction away from said right front panel, folding the right fly flap portion back upon itself along a line spaced from said right front panel and beyond said slide fastener elements, applying a row of stitches through the S-shaped tuck, the tape portion of the slide fastener stringer and the turned back portion of the right fly flap portion, doubling back the left fly flap portion on the reverse face of the left front panel along a predetermined line at the junction of the left front panel and the left fly flap portion, applying a row of stitches to secure the doubled back fold in place, forming an S-shaped fold in the left fly flap portion along a line spaced from said doubled back fold to provide a slit type pocket open toward said doubled back fold, inserting the tape portion of a slide fastener stringer in said pocket with the slide fastener elements being disposed in the direction toward the doubled back fold, applying a row of stitches through the S-shaped fold, in the left fly flap portion, the tape portion of the slide fastener stringer and the left front panel, and joining the left and right fly sections together at the crotch sections by applying stitching thereto.

18. A method according to claim 17 comprising, precutting said slide fastener stringers to a predetermined length.

19. A method according to claim 17 comprising, providing excess material in doubling back the left fly flap portion to present fullness in the fold, and tucking the excess material between the layers of the fold along the edge of said doubled back fold to provide a V-shaped insert between the layers of the fold.

20. A method according to claim 19 comprising, precutting said slide fastener stringers to predetermined length.

21. A method according to claim 19 comprising, creating two lips along the fold line during the tucking operation, and offsetting said tuck from the center line of said fullness in the fold to provide said two lips one of which is recessed behind the other.

22. A method of forming a fly structure for trousers or the like comprising, cutting left and right front panels from a supply of material with left and right front panels forming portions extending from the crotch portion to the waistband edge intergral with the front panels, forming an S-shaped fold in each of the left and right front panels to provide a slit type pocket in each which has its opening facing in the direction of the other pocket, maintaining each of said pockets in open position, inserting the tape portion of precut slide fastener stringers into the pockets with the slide fastener elements of each stringer extending toward the elements of the opposite stringer, clamping said pockets about said slide fastener stringers and holding the parts in position, applying a line of stitching to each of said assemblies in permanently secure them in position, and joining said left and right panels to each other at the crotch portion by applying stitching thereto.

23. A method according to claim 22 comprising, folding back the material of the left front panel upon itself along a predetermined line at the junction of the left front panel and the left fly flap forming portion, maintaining excess material in said fold to provide fullness, tucking said excess material inwardly between the layers of said fold to form a V-shaped insert, holding said layers and said V-shaped insert in position, and applying stitching through both layers of material and the V-shaped insert.

24. A method according to claim 23 comprising, making two lips of unequal length during the tucking of the excess material whereby one lip will be recessed behind the other.

25. In a fly construction for trousers or the like comprising, left and right panels having fly flap portions integral therewith, said panels being joined together adjacent said fly flap portions, one of said flaps overlying the other and being the exposed flap in the finished fly structure, said exposed flap having a fold in the material defining the exposed free edge thereof, and said fold being self reinforced with a plurality of layers of the material to provide rigidity to the exposed free edge.

26. A fly construction for trousers or the like according to claim 25 therein, said self reinforcing consists of an inverted portion of the material forming a substantially V-shaped insert between the layers of material with two lips along the exposed edge, and a row of stitching through both layers of material and the V-shaped insert securing the V-shaped insert in position.

27. A fly construction for trousers or the like according to claim 26 wherein, said lips are of unequal length whereby one lip will lie behind the other and not be visible from the front in the finished fly structure.

28. A method of forming a fly construction for trousers or the like comprising, cutting the front panels from material with at least one of said panels having a fly flap portion integral therewith and which will become the exposed fly flap in the completed structure, folding said fly flap portion along a predetermined line which is to become the exposed free edge of the flap in the finished structure, folding said fly flap along a line adjacent said first fold to provide a second fold line along said exposed free edge, and stitching said two folds together along said free edge.

29. The method of claim 28 comprising, making said second fold along a line to be recessed behind said first fold in the finished fly structure.

30. The method of claim 29 comprising, loosely doubling back said fly flap upon itself, and making a tuck in said fly flap portion to invert a portion of the material between the layers formed by doubling back the material and form the first and second folds.

31. In a fly construction having overlapping fly flap portions, one of which is exposed, for trousers or the like, a panel of suitable material forming a main body portion or the like, a fly flap portion integral with said panel, said fly flap portion forming the exposed flap in the completed fly construction, said flap portion having a fold therein defining the exposed free edge of the completed fly construction, and said fold being self reinforced with a plurality of layers of the material to provide rigidity to the exposed free edge.

32. A fly construction for trousers or the like according to claim 31 wherein, said self reinforing consists of an inverted portion of the flap material forming a substantially V-shaped insert between the layers of material with two lips along the exposed edge, and a row of stitching through both layers of material and the V-shaped insert securing the V-shaped insert in position.

33. A fly construction for trousers or the like according to claim 32 wherein, said lips are of unequal length whereby one lip will lie behind the other and not be visible from the front in the completed fly construction.

34. In a fly construction for trousers or the like, a panel forming a main body portion or the like, a fly flap portion integral with said panel, an S-shaped fold formed in said fly flap portion forming a slit type pocket in said fly flap portion, a slide fastener stringer of predetermined length having both halves attached to each other in closed position, one side of said slide fastener stringer being inserted in said pocket, and a row of stitches securing said slide fastener stringer in said pocket.

35. A method of forming a fly structure for trousers or the like comprising, cutting a main panel of the trousers or the like from a supply of material, cutting a fly flap portion from the supply of material integral with the main panel and attached to the main panel at a predetermined position, forming a pocket in said fly flap portion by making an S-shaped fold therein, holding said pocket in open position, cutting both halves of a slide fastener stringer to a predetermined length, attaching the halves of the slide fastener stringer together with their elements in closed positions, inserting one side of said slide fastener stringer in the open pocket with the slide fastener elements outside said pocket and extending parallel thereto, clamping said pocket and said slide fastener stringer together, and applying a row of stitches through all layers of material in the S-shaped fold and the slide fastener stringer to secure the slide fastener stringer in place.

* * * * *